US005319303A

United States Patent [19]

Yamada

[11] Patent Number: 5,319,303

[45] Date of Patent: Jun. 7, 1994

[54] CURRENT SOURCE CIRCUIT

[75] Inventor: Koichi Yamada, Shizuoka, Japan

[73] Assignee: Sony/Tektronix Corporation, Tokyo, Japan

[21] Appl. No.: 971,278

[22] Filed: Nov. 14, 1992

[30] Foreign Application Priority Data

Feb. 12, 1992 [JP] Japan ..... 4-58946
Feb. 12, 1992 [JP] Japan ..... 4-58947

[51] Int. Cl.[5] ..... G05F 1/56

[52] U.S. Cl. ..... 323/313; 323/316; 323/274; 323/281; 307/296.6

[58] Field of Search ..... 323/316, 312, 282, 281, 323/311, 313, 314, 315, 303; 307/296.6, 296.8; 363/21

[56] References Cited

U.S. PATENT DOCUMENTS

| | | | |
|---|---|---|---|
| 3,902,111 | 8/1975 | Pfisterer, Jr. | 323/316 |
| 3,959,717 | 5/1976 | Pitel | 323/316 |
| 3,986,101 | 10/1976 | Koetsch et al. | 323/281 |
| 4,349,777 | 9/1982 | Mitamura | 323/226 |
| 4,551,670 | 11/1985 | Anders et al. | 323/281 |
| 4,672,304 | 6/1987 | Degravwe et al. | 323/314 |
| 4,928,056 | 5/1990 | Pease | 323/314 |
| 4,929,883 | 5/1990 | Chieli | 323/282 |
| 4,994,685 | 2/1991 | Mathison | 307/66 |
| 5,084,666 | 1/1992 | Bolash | 323/281 |
| 5,153,499 | 10/1992 | Klesch | 323/280 |
| 5,227,964 | 7/1993 | Furuhata | 363/56 |

OTHER PUBLICATIONS

"Op amp stabilizer zener diode in reference voltage source," Miller et al., *Electronics*, Feb 20, 1975.

*Primary Examiner*—R. Skudy
*Assistant Examiner*—B. Davidson
*Attorney, Agent, or Firm*—Smith-Hill and Bedell

[57] ABSTRACT

A current source consists of a transistor having an emitting electrode connected to one end of a first resistor and a first operational amplifier that compares the voltage of the emitting electrode with a control voltage and controls a control electrode of the transistor through a second resistor. The voltage at the emitting electrode of the transistor is kept at a predetermined voltage by a second operational amplifier that compares the voltage at the emitting electrode with the predetermined voltage and controls the voltage at the other end of the first resistor. The control voltage source has a known source resistance. A third resistor is inserted between the non-inverting input and output terminals of the first operational amplifier. The second operational amplifier serves to make the maximum output voltage at the collecting electrode of the transistor high so that a power voltage usage efficiency of an electronic load is improved. The second resistor detects as a voltage the current of the control electrode or the base of the transistor and the detected voltage is applied to the first operational amplifier via a divider network comprising an appropriate ratio of the source resistance and third resistor so as to compensate an error in the output current.

17 Claims, 5 Drawing Sheets

CURRENT SOURCE CIRCUIT

BACKGROUND OF THE INVENTION

The present invention relates generally to a current source circuit, more specifically to a current source circuit whose output current can be adjusted from zero linearly and precisely and provide an electronic load receiving the output current with an improved power voltage usage efficiency.

A variable or constant current source circuit is used in many kinds of electronic circuits, such as an offset circuit, a ramp waveform generator and the like. When a current source circuit is used in an offset circuit to offset an output signal from a signal generator, the current from the current source circuit and the output signal from the signal generator are mixed and flow through a termination resistor or a resistor of a load. The offset voltage for the output signal is determined by the voltage across the resistor based on the current from the current source.

A conventional current source is shown in FIG. 1. The emitter of a bipolar NPN transistor 10 receives a supply voltage, such as −15 V, through a resistor 12 and is coupled to the inverting input terminal of an operational amplifier 14 serving as a differential amplifier. The base of the transistor 10 is coupled to the output terminal of the operational amplifier 14 and the collector thereof is connected to a properly biased electronic load circuit and produces a sink output current Iout. A control voltage source 16 providing a voltage Vcnt1 is connected between the non-inverting input terminal of the operational amplifier 14 and the −15 V supply voltage line. Power supply (driving) voltages for the operational amplifier 14 are −15 V and ground voltage. It should be noted that the −15 V power supply voltage is common to the transistor 10 via resistor 12 and the operational amplifier 14.

In the current source circuit shown in FIG. 1, the operational amplifier 14 controls the base of the transistor 10 in order to produce an emitter current equal to Vcnt1/R12, where R12 is the resistance of resistor 12, so that the voltage across resistor 12 will be the same as the voltage of the control voltage source 16 (Vcnt1); the voltage at the inverting input terminal of the amplifier 14 will be equivalent to the voltage present at its non-inverting input terminal. Ignoring the transistor base current, this emitter current is the same as the transistor collector current, Iout. Thus, the output current is variable and will change according to changes in Vcnt1.

Most operational amplifiers require that the output voltage remain between the operational amplifier's supply voltages with about a 2 V margin. In the case of FIG. 1, since the power supply voltages are −15 V and 0 V, the output voltage should be in the range between −13 V and −2 V. With this output voltage range, the control voltage magnitude must stay between +1.3 V and +12.3 V (operational amplifier's output voltage, minus a transistor base emitter voltage drop, minus the negative supply) in order for the operational amplifier to operate properly. This implies that the minimum voltage across resistor 12 is 1.3 V, so that the minimum current Iout is +1.3/R12. Therefore, the output current Iout remains greater than zero and the current source circuit cannot be used to produce small and variable offset currents close to zero or to generate a low speed ramp waveform.

This disadvantage can be overcome by another conventional current source circuit shown in FIG. 2. The difference between the circuits of FIGS. 1 and 2 is that the operational amplifier 14 receives its power supply voltages from a second voltage source. In other words, the lower end of the resistor 12 and the cathode of the voltage source 16 are connected to a power supply voltage of −12.5 V and the operational amplifier 14 receives a power supply voltage of −15 V. The voltage difference between these power supply voltages is 2.5 V because an extra 0.5 V margin is added to 2 V. Since the input voltage range of the operational amplifier 14 is between −13.7 V and −2.7 V (output range minus a base emitter voltage drop), the voltage across the resistor 12 can be set arbitrarily close to OV by adjusting the control voltage source 16. Thus, the minimum output current Iout can be set to zero.

FIG. 3 shows characteristic lines of the emitter voltage VE and the maximum output voltage (collector voltage) Vout of the transistor 10 wherein the control voltage Vcnt1 of the control voltage source 16 is variable in the range between 0 V and 2 V. In FIG. 3, the left vertical axis represents voltage, the right vertical axis represents the control voltage Vcnt1 for setting the output current Iout, and the horizontal axis represents the output current Iout as a percentage of the output current provided when the control voltage Vcnt1 is 2 V. The saturation voltage between the collector and emitter of the transistor 10 is assumed to be 0.5 V.

As will be understood from FIG. 3, a control voltage Vcnt1 equal to 0 V would produce an emitter voltage VE of −12.5 V. The output current Iout increases proportionally to the control voltage Vcnt1. The transistor 10 can operate properly in circumstances where the collector voltage exceeds the emitter voltage VE by the collector-emitter saturation voltage (0.5 V).

When the emitter resistor 12 of FIG. 2 is zero, the maximum output power Pmax delivered to the load is $$\text{Pmax}=(1/RL)[\text{Vcesat}+V-s]^2.$$

RL corresponds to the load resistance receiving Iout, Vcesat represents the transistor collector to emitter saturation voltage, and V−s is the negative supply voltage (−12.5 V in the case of FIG. 2). The load takes full advantage of the available collector voltage swing.

When the emitter resistor 12 is non-zero, it reduces the power available to the load resistor. It may be shown that $$\text{Ioutmax}=-(\text{Vcesat}+V-s)/RL+R12)$$

and that the maximum output power delivered to RL is $$\text{Pmax}=RL[(\text{Vsat}+V-s)/(RL+R12)]^2.$$

By re-arranging the output power equation, $$\text{Pmax}=(1/RL)[(\text{Vsat}+V-s)/(1+R12/RL)]^2$$

the reduced power may be seen as related to a reduction in voltage available at the collector, by a factor of $$1/(1+R12/RL).$$

Accordingly, it may be said that the emitter resistor affects the power voltage usage efficiency of the load receiving the output current.

There are also other considerations with respect to the prior art circuits which employ the bipolar transistor 10. On one hand, it is desirable to use a bipolar transistor having a small stray capacitance between the electrodes thereof in order to prevent high frequency component signals, which may be present in an electronic circuit serving as the load, from penetrating the current source circuit. Moreover, a non-ideal bipolar transistor has limited gain (hfe or $\beta$). With limited gain, the transistor flows a base current and the output collector current is less than the emitter current by the amount of this base current. In addition, the transistor gain will vary with temperature as will the base current and therefore the output current Iout will not be stable with temperature.

The error based on the base current can be avoided by exchanging the bipolar transistor 10 in FIG. 1 or 2 with a field effect transistor (FET). In this instance, the gate of the FET is connected to the output terminal of the operational amplifier 14, the source thereof is connected to the inverting input terminal of the operational amplifier 14 and the resistor 12, and the drain thereof acts as the current output terminal. Since no current flows through the gate of the FET, all the source current flows through the drain, thereby obviating the current error problem. However, the FET has a large stray capacitance between the electrodes thereof in comparison with the bipolar transistor, so that the FET will not be able to isolate high frequency signals between the drain and gate as effectively as a bipolar transistor between collector and base.

The current source circuit can be used as an offset circuit for a high frequency signal generator. In this instance, the output currents from both the current source and the signal generator flow through a load or a device under test. The current from the current source circuit generates a voltage across the load which corresponds to the offset voltage of the high frequency signal. When the current source circuit includes a FET in the output stage as discussed hereinbefore, the high frequency signal from the signal generator flows into the current source circuit via electrode stray capacitance of the FET. Thus, it is difficult to accurately apply the high frequency signal to the device under test (DUT) from the signal generator when the offset circuit is attached. The stray capacitance of the FET provides a high frequency by-pass for high frequency signals to follow a path around the DUT.

What is desired is a current source circuit that can change its output current linearly from zero and improves the power voltage usage efficiency of an electronic circuit receiving the output current from the current source circuit. In addition, what is desired is a current source circuit that employs a bipolar transistor having a small stray capacitance between its electrodes and can generate its output current accurately without being affected by the base current.

SUMMARY OF THE INVENTION

In this specification, an emitting electrode means both the emitter of a bipolar transistor and the source of a field effect transistor (FET), a control electrode means both the base of a bipolar transistor and the gate of a FET, and a collecting electrode means both the collector of a bipolar transistor and the drain of a FET. The term "transistor" means both a bipolar transistor and a FET.

According to one aspect of the present invention, the emitting electrode of a transistor is connected to one end of a resistor and the inverting input terminal of a first operational amplifier. The control electrode of the transistor is connected to the output terminal of the first operational amplifier. A control voltage means is inserted between the non-inverting input terminal of the first operational amplifier and the other end of the resistor. The output terminal of a second operational amplifier is connected to the other end of the resistor. The inverting input terminal of the second operational amplifier is connected to the emitting electrode of the transistor and the non-inverting terminal thereof receives a predetermined voltage. The collecting electrode of the transistor provides the output current.

The combination of the transistor, the resistor, the first operational amplifier and the control voltage means operates in a manner similar to the conventional current source for generating the output current. Since the second operational amplifier has a negative feedback path, the voltage at the emitting electrode of the transistor is kept at the same value as the predetermined voltage (applied to the non-inverting input terminal of the second operational amplifier) regardless of the output current from the collecting electrode. Thus, the maximum output voltage at the collecting electrode is determined by the predetermined voltage and the saturation voltage between the collecting and emitting electrodes of the transistor. By setting the predetermined voltage to an appropriate value, the power voltage usage efficiency of the device receiving the output current can be improved. Since the output voltage of the first operational amplifier is higher than the output voltage from the second operational amplifier, the output current can be changed linearly from zero.

According to another aspect of the present invention, a first reference voltage (e.g. ground voltage) is applied through a first resistor to the emitter of a bipolar transistor. The output current is provided at the collector of the transistor. The base of the bipolar transistor is coupled to the output terminal of an operational amplifier through a second resistor. The inverting input terminal of the operational amplifier is coupled to the emitter of the bipolar transistor and the non-inverting input terminal thereof is coupled to a control voltage source having a source resistance. A third resistor is inserted between the inverting input terminal and the output terminal of the operational amplifier.

The second resistor detects the base current of the bipolar transistor as a voltage. This detected voltage is divided by the source resistance and the third resistor and the divided voltage is added to the control voltage to compensate for the error in the output current based on the base current of the bipolar transistor.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference numbers refer to like elements.

DETAILED DESCRIPTION

Figure 4:
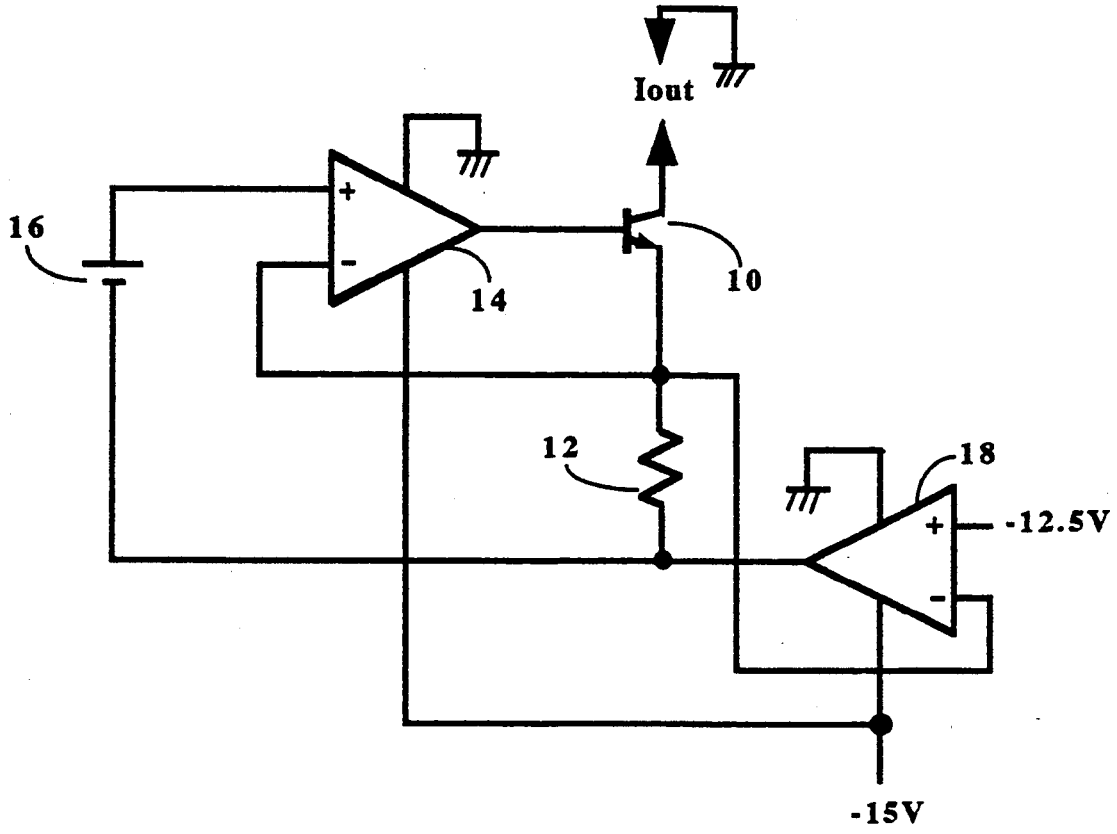
FIG. 4 is a circuit diagram of one embodiment of a current source circuit according to the present invention.

Referring to FIG. 4, there is shown a circuit diagram of a first embodiment of the present invention. In this embodiment, an NPN bipolar transistor is used as the transistor 10. However, a PNP bipolar transistor or an FET could also be used for the transistor 10 by properly adjusting the supply and bias voltages.

Figure 1:
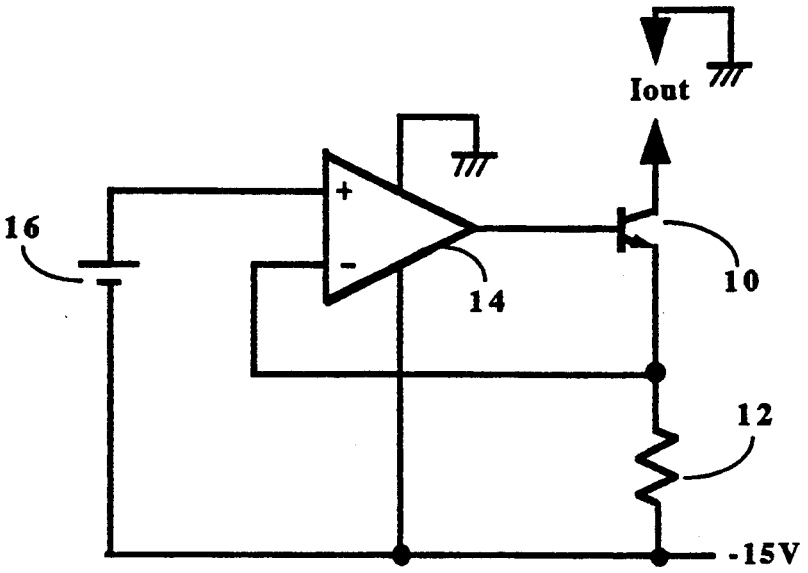
FIG.1 (PRIOR ART)
FIG. 1 is a circuit diagram of one of conventional current source circuits.
Figure 2:
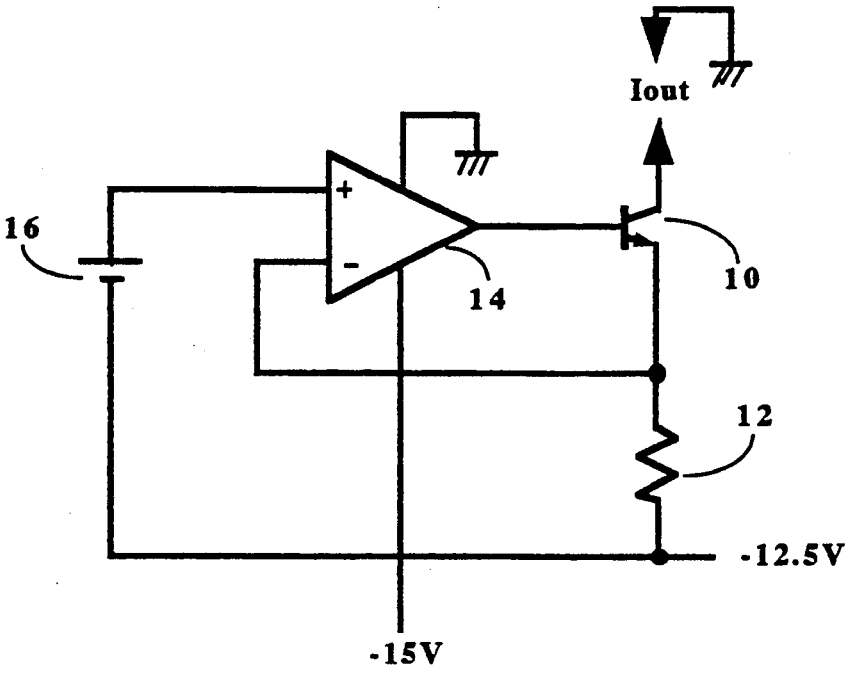
FIG.2 (PRIOR ART)
FIG. 2 is a circuit diagram of another conventional current source circuit.

The transistor 10, a resistor 12, an operational amplifier 14 serving as a differential amplifier and a control voltage source 16 are connected in the same manner as shown for the conventional current source circuit shown in FIG. 1 or 2. The electrical load is connected to the collecting electrode of the transistor 10 and is properly biased for driving the transistor 10. The output terminal of an operational amplifier 18 serving as a differential amplifier is coupled to the junction of the lower end of the resistor 12 and the cathode of the control voltage source 16. The inverting (−) input terminal of the operational amplifier 18 is coupled to the emitter of the transistor 10, and the non-inverting (+) input terminal thereof receives a reference voltage, e.g. −12.5 V. The operational amplifiers 14 and 18 receive a ground voltage and −15 V as the supply voltages.

The output of amplifier 14 must stay at least 2 V above the negative supply voltage −15 V. In addition, the input voltage of the operational amplifier 18 must also stay at least 2 V higher than the negative supply voltage −15 V. The reference voltage of −12.5 V applied to the non-inverting input of amplifier 18 is 2.5 V greater than the negative supply voltage and the output of amplifier 14 is about 3.2 V above the negative supply voltage.

Like the conventional current source circuit, the first operational amplifier 14 controls the base of the transistor 10 such that the voltage at the non-inverting input terminal of the amplifier 14 matches the voltage at the inverting input terminal. Since the resistor 12 and the cathode of the control voltage source 16 are connected in common, the voltage across the resistor 12 tracks the voltage of the control voltage source 16 (Vcnt1). Thus, a current flows from the emitter of the transistor 10 to the resistor 12; the value of this current is determined according to the resistance of the resistor 12 and the voltage of the control voltage. This current corresponds to the output current Iout and can be changed linearly from zero by changing the control voltage Vcnt1 from zero.

The second operational amplifier 18 produces the output voltage VN needed for keeping the voltage of the inverting and non-inverting input terminals matched and the emitter voltage of the transistor 10 is kept at the predetermined voltage −12.5 V regardless of the output voltage from the operational amplifier 14 and the output current Iout. The minimum collector voltage at the collector of the transistor 10 and the maximum magnitude of the voltage Vout across the load are limited by the collector-emitter saturation voltage (e.g. 0.5 V) of the transistor 10. In this instance, the maximum magnitude of the output voltage Vout is −12.5 V+0.5 V=+12 V.

Figure 3:
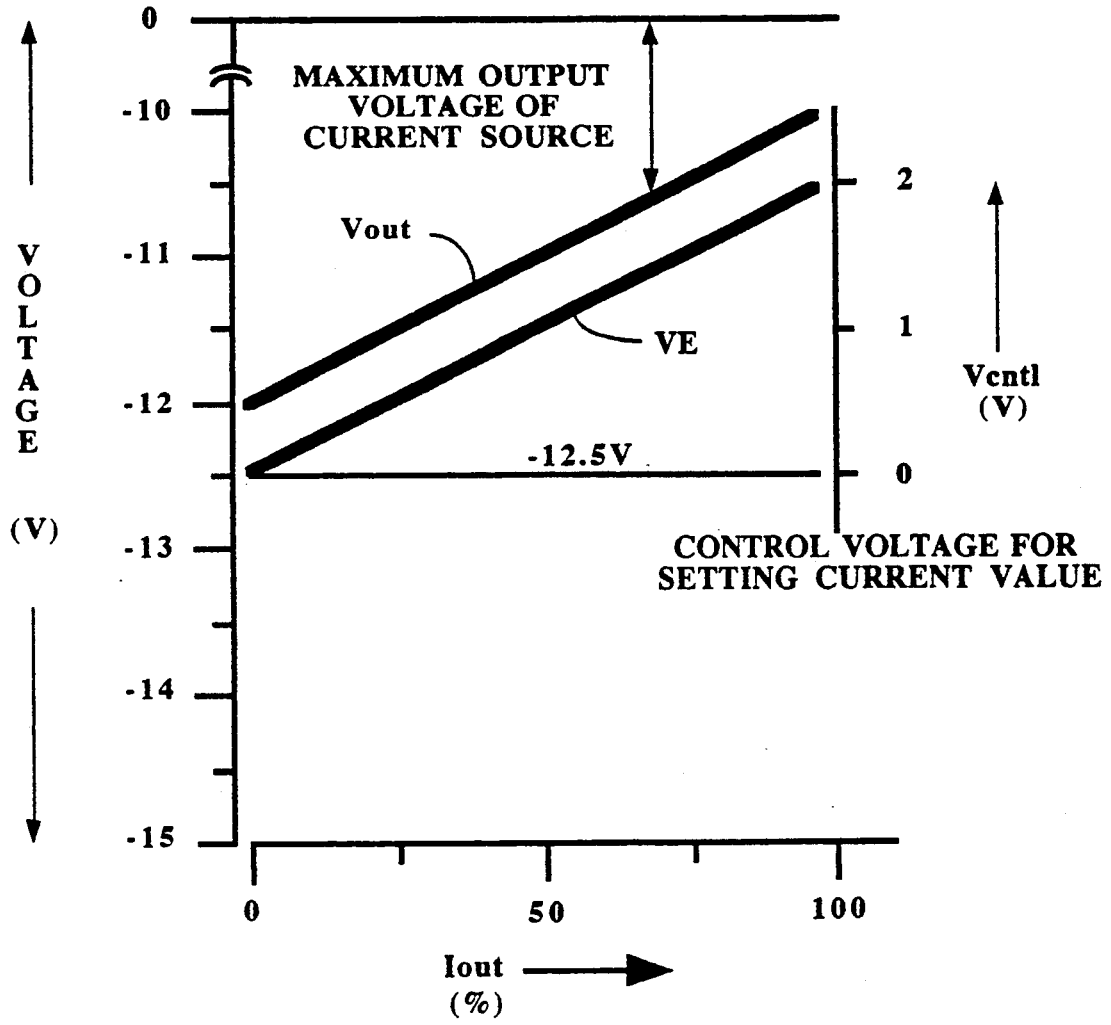
FIG.3 (PRIOR ART)
FIG. 3 shows characteristic lines for explaining an operation of the circuits shown in FIGS. 1 and 2.
Figure 5:
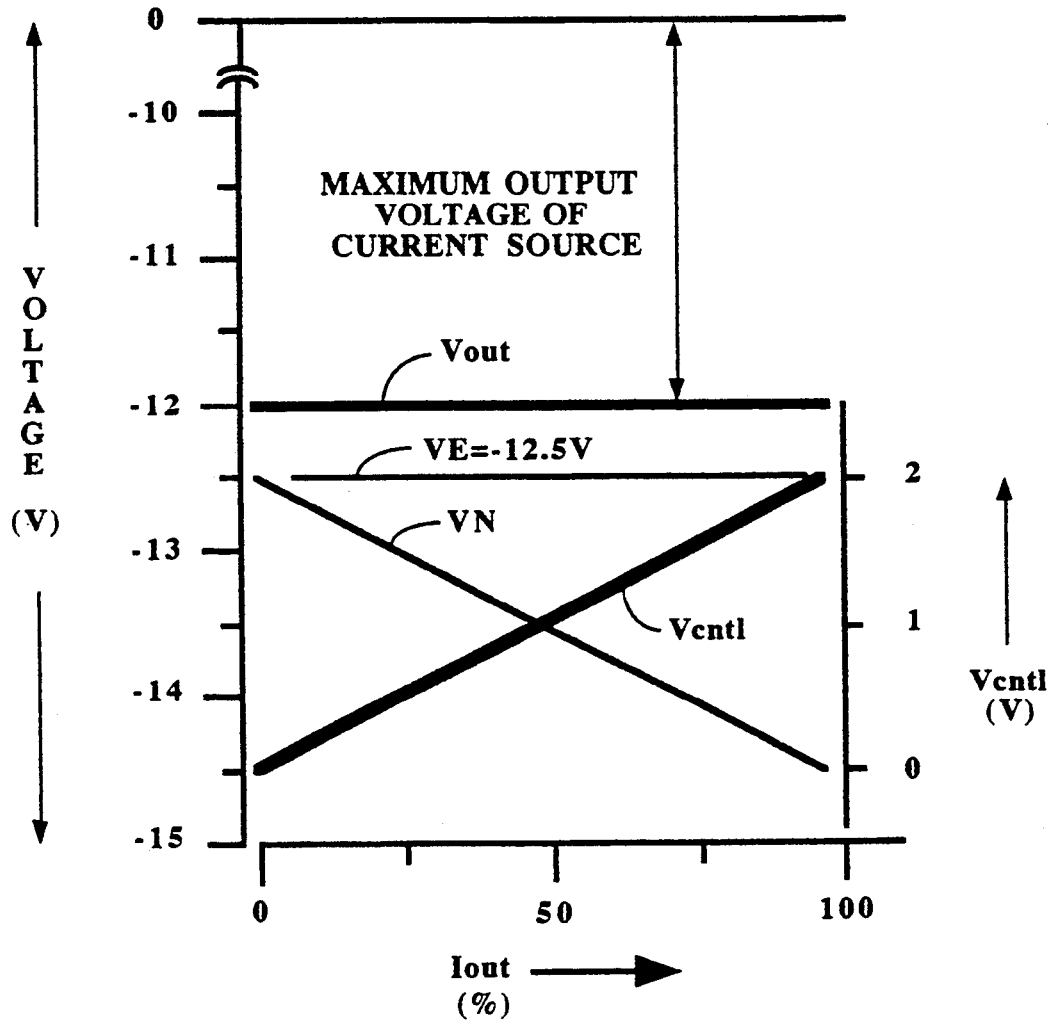
FIG. 5 shows characteristic lines for explaining an operation of the circuit shown in FIG. 4.

FIG. 5 shows characteristic lines for explaining the operation of the circuit shown in FIG. 4 wherein the control voltage Vcnt1 is changed between 0 V and 2 V. In FIG. 5, the left vertical axis represents voltage, the right vertical axis represents the control voltage and the horizontal axis represents the output current Iout (Iout=100% when Vcnt1=2 V). By comparing FIGS. 3 and 5, it is apparent that the present invention provides a larger load voltage than the prior art and that it improves the power voltage usage efficiency for the electronic circuit receiving the output current Iout.

Figure 6:
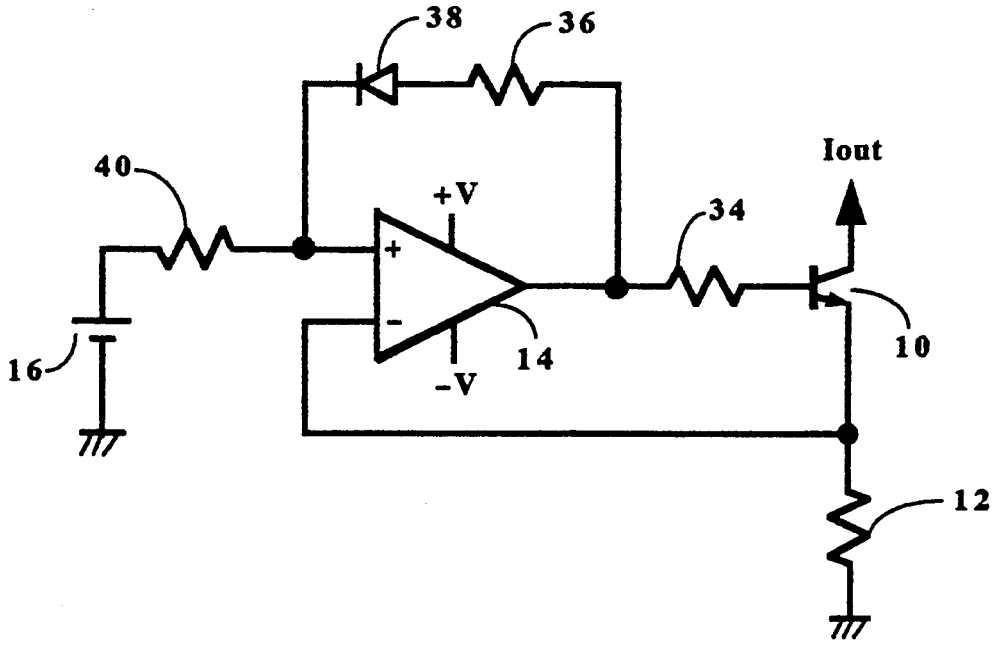
FIG. 6 is a circuit diagram of another embodiment of the current source circuit according to the present invention.

FIG. 6 shows a circuit diagram of another embodiment of the present invention. In FIG. 6, the transistor 10 should be a bipolar transistor (which may be an NPN transistor or a PNP with corresponding changes to the feedback). A base current detection resistor 34 is inserted between the output terminal of the operational amplifier 14 and the base of the NPN bipolar transistor 10 and a series connection circuit of a resistor 36 and a diode 38 is coupled between the non-inverting input terminal and the output terminal of the operational amplifier 14. A resistor 40 is connected between the non-inverting input terminal of the operational amplifier 14 and the control voltage source 16. The diode 38 is positioned with its anode nearest the base of the bipolar transistor 10. The diode 38 is used for compensating the base-to-emitter voltage VBE of the transistor 10, and should therefore be selected with characteristics similar to the base-emitter junction of the bipolar transistor 10.

The lower end of the resistor 12 and the cathode of the control voltage source 16 are connected to a common voltage, illustrated as ground in order to simplify the explanation of how the circuit operates. It should be noted that the common voltage may be offset to any desired voltage so long as the load connected to the collector of the bipolar transistor 10 is properly biased.

The circuit shown in FIG. 6 provides a means for stabilizing the output current Iout by compensating for base current fluctuations. The circuit detects the base current of transistor 10 as a voltage with the resistor 34, divides the detected voltage with the resistors 36 and 40 and sums the divided voltage with the voltage from the control voltage source 16 at the non-inverting input terminal of amplifier 14. With respect to the equations below, Iout represents the output current of the current source circuit which corresponds to the collector current of the bipolar transistor 10, IB is the base current of the bipolar transistor 10, VE is the emitter voltage of the bipolar transistor 10, VD is the forward voltage across the diode 38, Vcnt1 is the voltage of the control voltage source 16, V+ is the voltage at the non-inverting input terminal of the operational amplifier 14, VO is the output voltage of the operational amplifier 14, and R12, R34 and R40 represent the values of the resistors 12, 34 and 40 respectively. Note, the control voltage source 16 and R40 may be considered in combination as a voltage source having a source resistance R40.

The output current Iout is as follows:

$$Iout = IE - IB \quad (1)$$

The emitter current IE of the transistor 10 is represented by the following equation.

$$IE = VE/R12 \quad (2)$$

The output voltage VO of the operational amplifier 14 is $$VO = R34 \times IB + VE + VBE \quad (3)$$

The voltage V+ at the non-inverting input terminal of the operational amplifier 14 is $$V+ = [R40/(R40+R36)] (VO - VD - Vcnt1) + Vcnt1. \quad (4)$$

By substituting for VO from equation (3), $$V+ = [R40/(R40+R36)] (R34 \times IB + VE + VBE - VD - Vcnt1) + Vcnt1. \quad (4a)$$

Since VBE−VD=0, $$V+ = [R40/(R40+R36)] (R34 \times IB + VE - Vcnt1) + Vcnt1. \quad (5)$$

Since the operational amplifier 14 operates to maintain the relationship V+=VE, equation (5) may be changed to $$VE = [R40/(R40+R36)] (R34 \times IB + VE - Vcnt1) + Vcnt1.$$

This equation may be represented as follows by rearranging terms of VE.

$$VE = (R40/R36) \times R34 \times IB + Vcnt1 \quad (6)$$

Iout is obtained by modifying equations (1) and (2).

$$Iout = (VE/R12) - IB \quad (7)$$

By substituting for VE from equation (6), $$\begin{aligned} Iout &= (R40/R36) \times (R34/R12) \times IB + (Vcntl/R12) - IB \\ &= (Vcntl/R12) + [(R40/R36) \times (R34/R12) - 1] \times IB. \end{aligned} \quad (8)$$

A condition where the output current Iout is not affected by the base current of the bipolar transistor 10 is obtained as follows from equation (8).

$$(R40/R36) \times (R34/R12) - 1 = 0 \quad (9)$$

This equation can be satisfied by determining the ratios among R12, R34, R36 and R40 as follows:

$$R40:R36 = R12:R34 \quad (10)$$

If this equation (10) is satisfied, the output current Iout is determined only by the values of the resistor 12 and the control voltage source 16 regardless of the base current.

The base-to-emitter voltage drop of transistor 10 changes with temperature and this change would be fed back to the non-inverting input terminal of amplifier 14 through the voltage divider network if the diode 38 were not in the series feedback path. Accordingly, a change in the base-to-emitter voltage drop would alter the desired output current. By placing diode 38 in the series feedback path, a voltage drop is provided in the feedback path which will change with respect to temperature in a manner similar to the transistor's base-to-emitter voltage drop and the diode's voltage drop compensates for the transistor's base-to-emitter voltage drop. So while the resistor ratio compensates for changes in base current, the diode 38 compensates for changes in transistor VBE voltage drop with respect to temperature.

Figure 7:
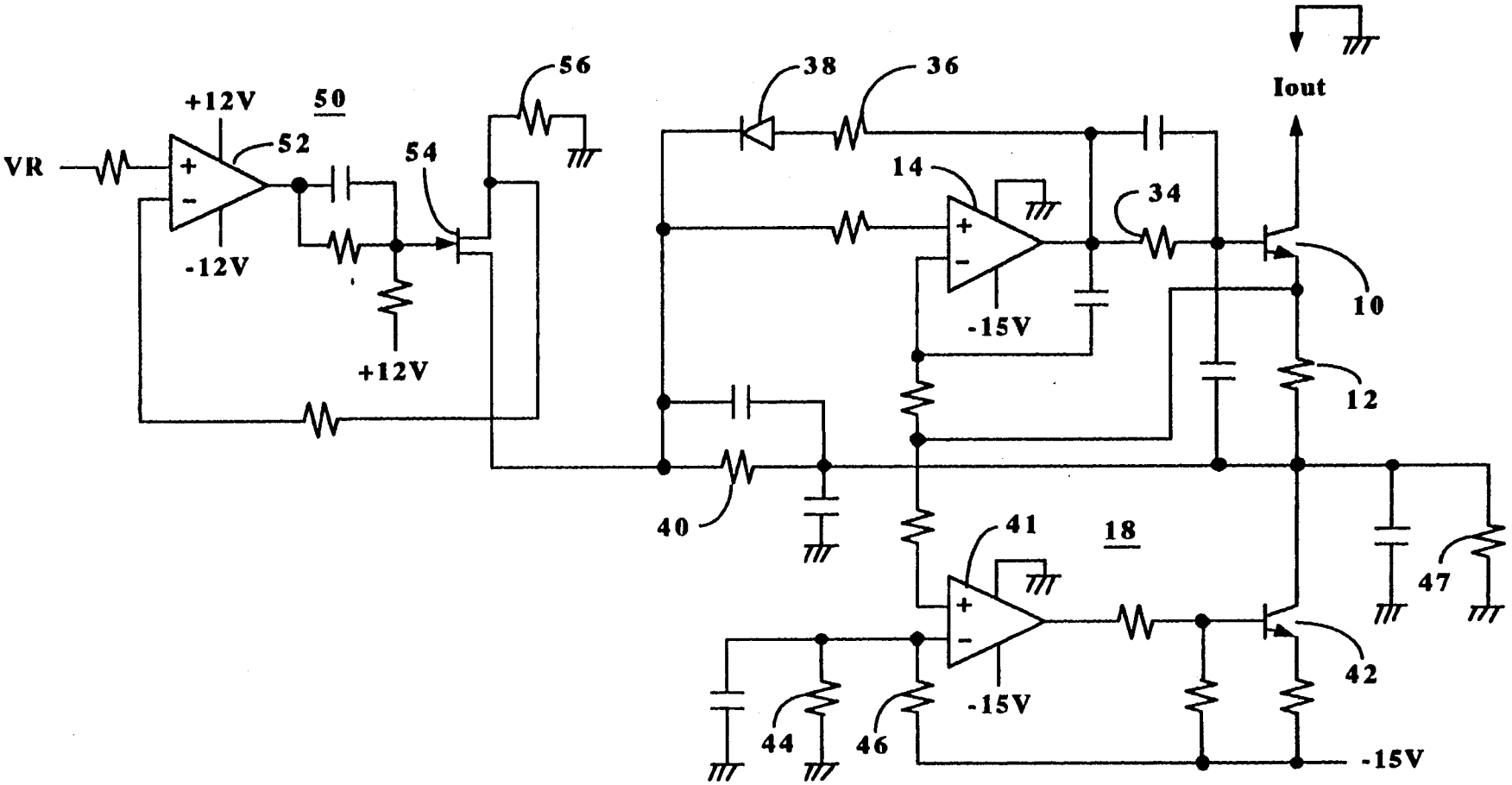
FIG. 7 is a circuit diagram of another embodiment of the current source circuit according to the present invention.

FIG. 7 is a circuit diagram of a third embodiment of the present invention that is a combination of the embodiments of FIGS. 4 and 6. In this embodiment, the second operational amplifier 18 consists of an operational amplifier 41 and its output inverting amplifier, namely, an NPN bipolar transistor 42. Thus, the inverting and non-inverting input terminals of the second operational amplifier 18 correspond to non-inverting and inverting input terminals of the operational amplifier 41. The predetermined voltage applied to the non-inverting input terminal of the second operational amplifier 18 (i.e., the inverting input terminal of the operational amplifier 41) is produced by dividing the power supply voltage −15 V with resistors 44 and 46.

The output voltage from the operational amplifier 41 is applied to the base of the transistor 42 through a voltage divider. The non-inverting input terminal of the operational amplifier 41 is coupled to the emitter of transistor 10 through a resistor.

The combination of a current source 50 and a resistor 40 forms the control voltage source 16 and source resistance which were inserted between the non-inverting input terminal of the first operational amplifier 14 and the lower end of the resistor 12. The resistor 40 is connected between the non-inverting input terminal of the operational amplifier 14 and the lower end of the resistor 12. The current source 50 applies a constant current to the resistor 40 and the voltage across this resistor 40 is used as the control voltage. It may be said that the current source and R40 represent the Thevenin equivalent circuit of a control voltage source having a source resistance of R40.

The constant current source 50 includes an operational amplifier (or differential amplifier) 52, a FET 54, a resistor 56 and other components. The resistor 56 is connected to the source of the FET 54, the output terminal of the operational amplifier 52 is connected to the gate of the FET 54 through a resistor network serving as a voltage divider and the drain of the FET 54 is connected to the resistor 40. The relationship among these components is similar to that of the operational amplifier 14, the transistor 10 and the resistor 12 and the output current from this current source 50 is determined by a reference voltage VR at the non-inverting input terminal of the operational amplifier 52 and the value of the resistor 56. By changing the voltage VR, the output current from the current source 50 changes and modifies the voltage (control voltage Vcnt1) across the resistor 40; which in turn affects the output current Iout from the collecting electrode of the transistor 10. Resistor 47 assures that there is always a current through Q42.

Thus, the combination of the elements 10, 12, 14, 18, 40 and 50 corresponds to the embodiment shown in FIG. 4 and operates similarly to FIG. 4.

The combination of the elements 10, 12, 14, 34, 36, 38, 40 and 50 corresponds to the embodiment shown in FIG. 6 and operates similarly to FIG. 6. It should be noted that the resistor 40 is used as a part of the control voltage source and a part of the voltage divider with the resistor 36.

As being understood from the foregoing description, this invention can change the output current linearly from zero and improves the power voltage usage efficiency of the electronic load receiving the output current. It enables the use of a bipolar transistor having a small electrode capacitance in order to maintain the output impedance for higher frequencies. In this instance, this invention can produce an output current that is not affected by fluctuations in base current or base-to-emitter voltage as might result from changes in the surrounding temperature of the bipolar transistor.

Having shown and described herein the predetermined embodiments of the invention, it will be apparent to those skilled in the art that many changes and modifications may be made without departing from the invention in its broader aspect. For example, a PNP transistor may be used as the transistor 10. In this instance, the bias voltages should be modified and the polarity of the diode 38 should be changed. The control voltage means 16 may be a constant voltage source or a variable voltage source. The resistor 12 may be a variable resistor. Therefore, the scope of the present invention should be determined only by the following claims.

I claim:

1. A current source circuit, comprising:

a first operational amplifier;

a transistor having an emitting electrode coupled to one end of a first resistor and to an inverting input terminal of said first operational amplifier, and having a control electrode coupled to an output terminal of said first operational amplifier;

control voltage means connected between a non-inverting input terminal of said first operational amplifier and the other end of said first resistor; and a second operational amplifier having an output terminal coupled to the other end of said first resistor, an inverting input terminal coupled to the emitting electrode of said transistor and a non-inverting input terminal receiving a predetermined voltage so as to maintain the emitting electrode of said transistor at said predetermined voltage;

wherein an output current is obtained from a collecting electrode of said transistor.

2. A current source circuit according to claim 1, wherein said transistor is one of a bipolar transistor and a field effect transistor.

3. A current source circuit according to claim 1, wherein said first and second operational amplifiers are differential amplifiers.

4. A current source circuit according to claim 1, wherein said control voltage means comprises a second resistor inserted between the other end of said first resistor and the non-inverting input terminal of said first operational amplifier and a current source for applying a current to said second resistor.

5. A current source circuit according to claim 1, wherein said first operational amplifier receives a first power supply voltage and a second power supply voltage, and said predetermined voltage is within the range between said first power supply voltage and said second power supply voltage and differs from the first power supply voltage by substantially less than it differs from said second power supply voltage.

6. A current source circuit according to claim 5, wherein the transistor is an NPN transistor and the first power supply voltage is negative relative to the second power supply voltage.

7. A current source circuit, comprising:

a bipolar transistor having a collector to produce an output current and an emitter coupled to a first reference voltage source through a first resistor;

an operational amplifier having an output terminal coupled to a base of said bipolar transistor through a second resistor, an inverting input terminal coupled to the emitter of said bipolar transistor and a non-inverting input terminal coupled to a control voltage source having a source resistance; and a third resistor coupled between the output terminal and the non-inverting input terminal of said operational amplifier, and wherein a resistance ratio of said first resistor to said second resistor is equal to that of said source resistance to said third resistor.

8. A current source circuit according to claim 7, wherein said control voltage source comprises a series combination of a resistor having a resistance value equal to said source resistance, and a substantially ideal voltage source, said series combination being connected between the non-inverting terminal of said operational amplifier and said first reference voltage source.

9. A current source circuit according to claim 7, wherein said control voltage source comprises a parallel combination of a resistor having a resistance value equal to said source resistance and a substantially ideal current source, said parallel combination being connected between the non-inverting terminal of said operational amplifier and said first reference voltage source.

10. A current source circuit according to claim 7, wherein said operational amplifier is a differential amplifier.

11. A current source circuit according to claim 7, further comprising a diode connected in series with said third resistor.

12. A current source circuit, comprising:

a first operational amplifier;

a bipolar transistor having an emitter coupled to one end of a first resistor and to an inverting input terminal of said first operational amplifier, and having a base coupled to an output terminal of said first operational amplifier through a second resistor;

a control voltage source having a source resistance, said control voltage source being connected between a non-inverting input terminal of said first operational amplifier and the other end of said first resistor;

a second operational amplifier having an output terminal coupled to the other end of said first resistor, an inverting input terminal coupled to the emitter of said bipolar transistor and a non-inverting input terminal receiving a predetermined voltage; and a third resistor coupled between the output and non-inverting terminal of said first operational amplifier, a resistance ratio of said first resistor to said second resistor being equal to that of said source resistance to said third resistor;

wherein an output current is obtained from a collector of said bipolar transistor.

13. A current source circuit according to claim 12, wherein said control voltage source comprises a series combination of a resistor having a resistance value equal to said source resistance and a substantially ideal voltage source, said series combination being connected between the non-inverting input of said first operational amplifier and the other end of said first resistor.

14. A current source circuit according to claim 12, wherein said control voltage source comprises a parallel combination of a resistor having a resistance value equal to said source resistance and a substantially ideal current source, said parallel combination being connected between the non-inverting input of said first operational amplifier and the other end of said first resistor.

15. A current source circuit according to claim 12, wherein the first operational amplifier receives a first power supply voltage and a second power supply voltage, and said predetermined voltage is within the range between said first power supply voltage and said second power supply voltage and differs from the first power supply voltage by substantially less than it differs from said second power supply voltage.

16. A current source circuit according to claim 15, wherein the transistor is an NPN transistor and the first power supply voltage is negative relative to the second power supply voltage.

17. A current source circuit according to claim 12, further comprising a diode connected in series with said third resistor.

* * * * *